United States Patent [19]

James

[11] Patent Number: 4,457,396

[45] Date of Patent: Jul. 3, 1984

[54] SOUND DEFLECTOR FOR HEADSET EAR PHONES

[76] Inventor: David L. James, 5250 E. 16th. St., Tucson, Ariz. 85711

[21] Appl. No.: 423,015

[22] Filed: Sep. 24, 1982

[51] Int. Cl.[3] ..... H04R 25/00

[52] U.S. Cl. ..... 181/136; 181/129

[58] Field of Search ..... 181/129, 133, 136, 132; 128/152; 179/156 R, 178, 182 R, 182 A, 107 R

[56] References Cited

U.S. PATENT DOCUMENTS

| | | | |
|---|---|---|---|
| 1,279,396 | 9/1918 | Michelson et al. | 128/152 |
| 1,761,666 | 6/1930 | Hinternesch | 181/133 |
| 2,619,960 | 12/1952 | Reynolds | 128/152 |
| 3,414,685 | 12/1968 | Geib | 179/104 E |
| 3,565,069 | 2/1971 | Miller | 128/152 |
| 3,730,181 | 5/1973 | Fling | 128/152 |
| 3,819,879 | 6/1974 | Baechtold | 179/182 R |
| 3,842,829 | 10/1974 | Ellis | 128/152 |

*Primary Examiner*—Benjamin R. Fuller
*Attorney, Agent, or Firm*—J. Michael McClanahan

[57] ABSTRACT

A sound deflector for attachment to a user's headset earphones is disclosed comprising means situated intermediate the headset earphone and a user's ear canal, said means comprising a hollow cylinder adapted to be operably connected to the headset earphone speaker case and thereby confine the sound from the speaker interiorly to the cylinder, and a cone spatially located proximate the opening of the hollow cylinder and aligned between the earphone speaker and the user's ear canal, a plurality of openings interposed the hollow cylinder wall and the sides of the spatially located cone, said cone adapted to reflect sound waves from the earphone speaker directed towards the user's ear canal and the openings pass sound waves directed away from the user's ear canal and into the folds of skin of the outer ear to be reflected then into the ear canal for hearing by the user.

10 Claims, 9 Drawing Figures

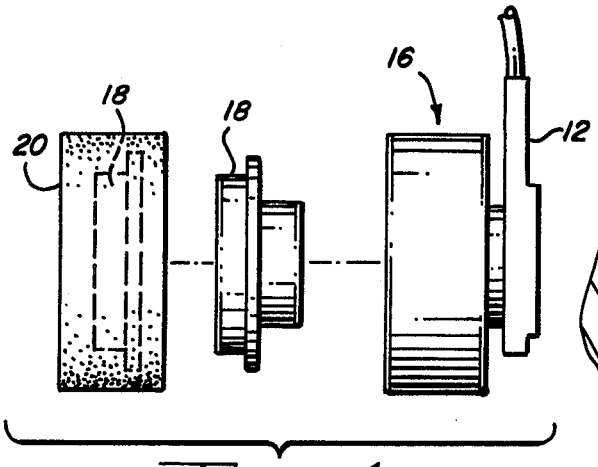
FIG. 1
(PRIOR ART)
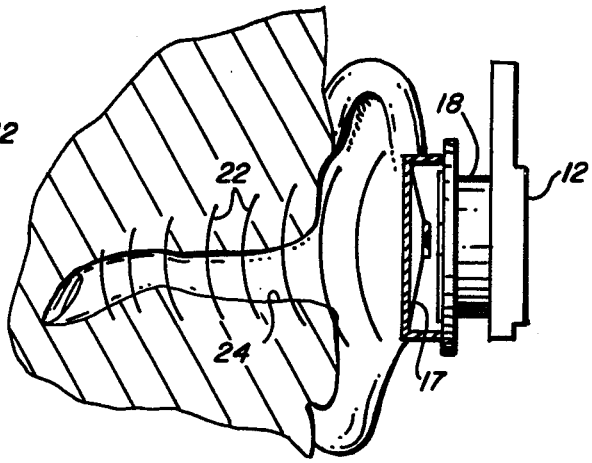
FIG. 2
(PRIOR ART)
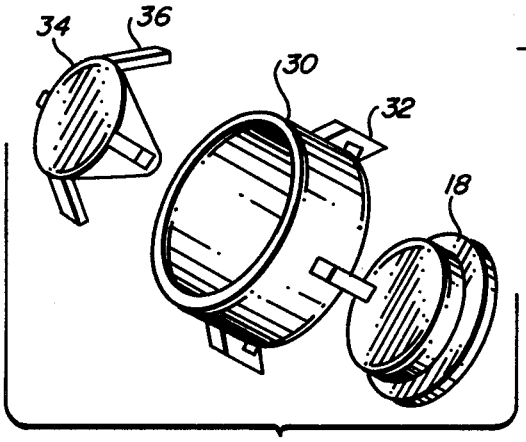
FIG. 3
FIG. 4
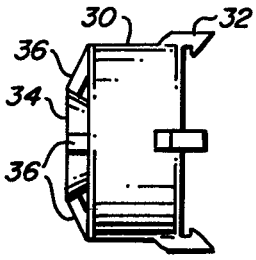
FIG. 5
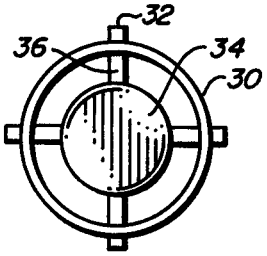
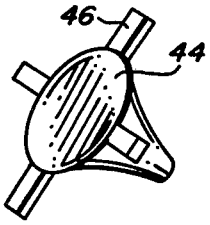
FIG. 6
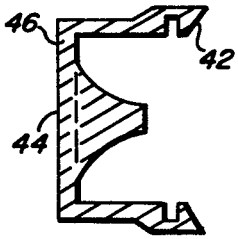
FIG. 7
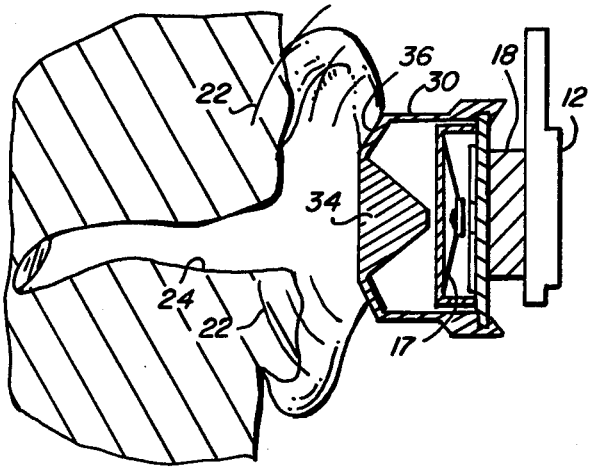
FIG. 8
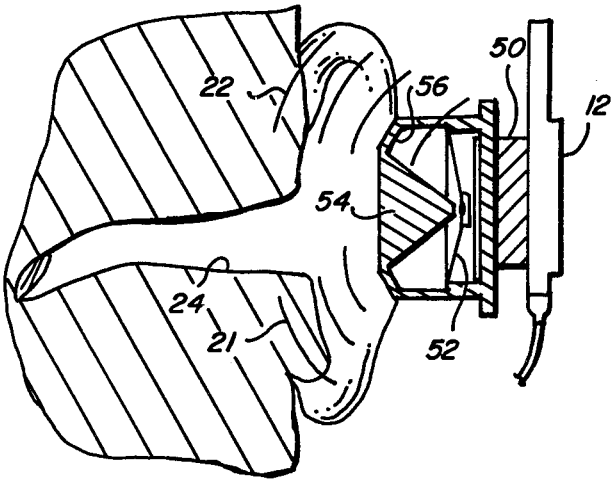
FIG. 9

SOUND DEFLECTOR FOR HEADSET EAR PHONES

BACKGROUND OF THE INVENTION

With the rise in popularity of the carry-around cassette tape recorders and portable radios with their connecting headset earphones, it has been discovered that ear damage is now beginning to manifest itself in the habitual wearers of the headset apparatus. Numerous articles have appeared in the medical journals, especially in those countries that have rather large populations utilizing these headsets, as well as in the popular news magazine generally directed to the public.

The cases first appearing indicating the impairment of hearing resulting in reports in the journals and magazines show that it is common practice for the wearers of the headsets to adjust the sound at rather high levels, and in many cases to wear the headset for extended periods of time.

It is believed that the damage is caused in large part by the directing of the sound waves straight into the ear canal by the speakers of the headsets. In normal hearing, very little sound enters the ear canal straight-on, but rather is first received by the folds of skin of the outer ear and thereby directed into the ear canal. The large surface of the outer ear, in relationship to the size of the opening of the ear canal, tends to concentrate the sound for better hearing and the outer ear's skin folds are very functional in that regard.

However, the normal function of the folds of skin of the outer ear are obviated when the loud speaker of the headset is situated right at the entrance to the ear canal such as is the common construction of the headset.

It is to the end of deflecting the sounds from a headset speaker first to the folds of the outer ear for eventual reflection to the ear canal that the subject invention is directed.

SUMMARY OF THE INVENTION

The subject invention relates to means for deflection of audio sound waves emerging from a headset speaker aimed directly at the ear canal into the folds of skin of the outer ear.

The detachable device for deflecting sound of a headset earphone speaker comprises a rather short hollow cylinder adapted to be attached to the speaker case of the headset by means of spring action clips attached to the hollow cylinder sides. This hollow cylinder surrounds and encloses the speaker of the headset so as to control all emination of sound. Proximate the opposite end of the hollow cylinder is a centrally located cone in axial spatial alignment with the earphone speaker, the cone adapted to deflect the sound waves eminating axially from the speaker directly to the ear canal. Openings are provided between the inner periphery of the short hollow cylinder and the tapered sides of the cone to permit side directed sound not intersected by the cone to pass out of the hollow cylinder. The hollow cylinder with the speaker interiorly is so aligned to place the cone between the speaker and the user's ear canal. The side directed sound which escapes the openings between the hollow cylinder and the cone tapered sides strikes the folds of the skin of the outer ear and thus is reflected into the ear canal.

An alternate embodiment of the subject device combines the short hollow cylinder with the speaker case interiorly and the centrally located cone with openings into a permanent part of the headset earphone and is not a detatchable device.

It is an object of the subject invention to provide a means intercepting sound waves from a headset speaker directed straight into the ear canal.

It is further an object of the subject invention to provide detatchable means to direct the sound waves from a headset earphone speaker into the folds of skin of the outer ear.

Other objects of the invention will in part be obvious and will in part appear hereinafter. The invention accordingly comprises the apparatus possessing the construction, combination of elements, and arrangement of parts which are exemplified in the following detailed disclosure, and the scope of the application which will be indicated in the claims.

BRIEF DESCRIPTION OF THE DRAWINGS

For further understanding of the nature and objects of the present invention, reference should be had to the following detailed description taken in connection with accompanying drawings wherein:

FIG. 1 is a block schematic drawing of the prior art;

FIG. 2 is a cross-sectional view of the prior art in place proximate a user's ear;

FIG. 3 is a perspective view of the subject invention;

FIG. 4 is a side view of the subject invention;

FIG. 5 is a top view of the subject invention;

FIG. 6 is an alternate embodiment of a portion of the subject invention;

FIG. 7 is a cross-sectional view of the alternate embodiment of the subject invention;

FIG. 8 is a cross-sectional view of the subject invention proximate a user's ear canal; and FIG. 9 is an alternate embodiment of the subject invention proximate a user's ear canal.

In the various views, like index numbers refer to like elements.

DETAILED DESCRIPTION OF THE PREFERRED EMBODIMENT

Referring now to FIG. 1 a block schematic diagram is shown of the present state of the art, i.e., the so called "micro" headsets of the type utilized with the presently available ultra-compact personal cassette tape players and carry-around radios. Shown in FIG. 1 is a portion of a micro headset, and its broken out components, here one that would be used with a person's left ear.

The headset for the right ear is exactly the same and is situated in a mirror-image configuration. Beginning from the right, the headset for the ear is shown comprising the frame 12 which provides for attachment of the speaker case having the speaker interiorly, the speaker connected with electrical wires 14 which run to the cassette tape player or other source of electrical audio signals. Electrical wire 14 continues through frame 12 and through the arcuate portion (not shown) which surrounds the head, connecting with the speaker for the right side ear. The headset 16 attached to frame 12 has been broken down into its major components immediately to the left com- prising the speaker case 18 which houses the speaker interiorly and the foam cover 20 which covers completely the speaker case 18 (as shown in dotted fashion).

Referring now to FIG. 2, a cross-sectional view of a person's left ear and partial headset is shown having the micro headset in position, without the foam cover for clarity, directing the sound waves 22 interiorly to the ear canal 24 to impinge upon the eardrum. More specifically, frame 12 has attached speaker case 18 with the speaker cone 17 situated therein directing the sound waves 22 directly into the ear canal 24. It is apparent from the drawing of FIG. 2 why damage is being caused the eardrums resulting in hearing loss to persons who wear the micro headsets or, for that matter, any earphone headset which directs sound into the ear canal.

Referring now to FIG. 3, a perspective view is shown of the subject inventive means to deflect sound from the speaker of the headset away from a position looking into the ear canal, and directing the sound into the folds of the outer ear initially so the sound can work its way into the ear canal by bouncing off the sides of the outer ear prior to entrance into the ear canal and impinging upon the eardrum. First recognized is the speaker case 18 which is the same speaker case 18 as shown in the prior art of FIGS. 1 and 2. Attached to an annular flange of the speaker case 18 is a short hollow cylinder 30 attached by means of spring clips 32, clips 32 attached to the outside perimeter of hollow cylinder 30. The clips have a notch on their interior to engage the flange of speaker case 18. The clip immediately forward of the notch engaging the speaker case 18 flange is sharpened to ride over the speaker case 18 flange, forcing the clip slightly outward until the notch drops over the flange.

Immediately to the left of hollow cylinder 30 is cone 34, here shown broken away from hollow cylinder 30, cone 34 held substantially in the inside of hollow cylinder 30 by means of attachment structure 36. Cone 34 position relative to hollow cylinder 30 may be either completely within the hollow cylinder 30 or substantially completely out of hollow cylinder 30. FIGS. 4 and 7 show two embodiments of placement of cone 34 relative to hollow cylinder 30. Cone 34 takes the configuration of a conical frustum, having two parallel circular flat surfaces connected by straight tapered sides. The reflecting cone is mounted such that its axis is perpendicular to the flat plane of the speaker and the apex of the cone is closest to the speaker. The attachment structure 36 as shown in FIG. 3 is, in the preferred embodiment, a portion of the construction of hollow cylinder 30, it being anticipated that hollow cylinder 30, its clips 32, cone 34, and attachment structures 36 will be constructed from a single piece of material, nominally hard plastic, hard rubber, or the like, which would be prepared by injection molding. This of course, is not to preclude assembly of the various pieces comprising the structure and bringing them all together with an appropriate adhesive.

The inner diameter of hollow cylinder 30 is so sized as to be only slightly larger than the upright sides of the disk-like portion of the speaker case 18, the idea being to confine the sound from the enclosed speaker totally to the hollow cylinder.

Referring now to FIG. 4, a side view of the subject invention is shown having all the elements previously detailed in FIG. 3, namely the primary portion of the construction, i.e., hollow cylinder 30 with its attaching clips 32, centrally located cone 34 situated partly out of hollow cylinder 30, and attachment structures 36.

Further, FIG. 5 shows in a top view, the central placement of cone 34 within the circular portion of hollow cylinder 30, and the attaching structures 36. It is noted in FIG. 4 that the placement of cone 34 relative to hollow cylinder 30 is such that the cone is partially outside the entrance to hollow cylinder 30 with substantially the major portion of the cone length within the hollow middle portion of hollow cylinder 30. This may be contrasted with an alternate embodiment detailed below.

Referring now to FIG. 6, an alternate embodiment of the centrally located cone within hollow cylinder 30 is shown. Here, cone 44 has non-straight tapering sides following a curve somewhat as a parabola, the sides still connecting the two flat circular surfaces on opposite ends of the cone. The attachment structures 46 shown in FIG. 4 now emerge from the larger flat circular surface of cone 44 in a direction parallel to the surface of cone 44 where they, in turn, attach to the inside surface of hollow cylinder 40 (FIG. 7) which in turn, is adapted to attach to the speaker case 18 flange. As seen in FIG. 7, a cross-sectional view, the flat circular surface of the cone 44 is now in line with the top annular edge of hollow cylinder 40 such that the top surface of all elements are in the same plane, i.e., the top surfaces of cone 44, attachment structures 46, and annular edge of hollow cylinder 40.

It is noted in FIGS. 3 through FIG. 7 that various configurations are possible for the construction of the tapered sides of the cone, as well as various configurations of the spatial placement of the cone relative to the circular end of the hollow cylinder. In the preferred embodiment, the cones utilized have been solid material cones although a cone having a cavity interiorly would also be acceptable since it is the outside surface of the tapering walls which are functional in deflecting the audio sounds eminating from the speaker enclosed in the speaker case.

Referring now to FIG. 8, a cross-sectional view of the preferred embodiment of the device in use is shown. Firstly, frame 12 has attached to it the usual speaker case 18 with its centrally located speaker cone 17. Immediately in front, and in alignment with speaker cone 17, is cone 34, the sides of which are so positioned to deflect sound directed at it, and pass only that sound not intersecting with the sides of cone 34. The sound which does pass the sides of cone 34 exits the hollow cylinder 30 through the opening between cone 34 and the inside portion of hollow cylinder 30, except when the opening is broken by attachment structure pieces 36 (see FIG. 5). As can be seen in the embodiment of FIG. 8, the sound waves 22 coming from the speaker now strike the folds of skin of the outer ear requiring them to bounce back and forth before entering the ear canal 24. At this point, the subject device has accomplished its purpose of deflecting sound waves which would otherwise enter directly into the ear canal and damage the eardrum, deflecting such sound waves and allowing only those sound waves to pass not directed into the ear canal but into the folds of the skin of the outer ear.

It is noted that the view shown in FIG. 8 does not have the foam cover as was the case in the prior art. It is realized of course that a foam cover similar to foam cover 20 of FIG. 1 may be utilized to cover cone 34, hollow cylinder 30, and speaker case 18 or any part of these without affecting the function and purpose of the subject device. The invention will operate with or without the foam cover, and may be used as desired by the operator.

Referring now to FIG. 9, still another alternate embodiment of the subject device is shown in cross-sectional view in place proximate the ear where in this view the hollow cylinder containing the cone has been molded together with the speaker case containing the speaker. More specifically, attached to frame 12 is the combined speaker case-hollow cylinder 50 which houses the speaker interiorly (showing a portion of the speaker cone 52) and centrally located sound deflecting cone 54 immediately over the speaker with attachment structures 56 connecting cone 54 to the combined speaker case-hollow-cylinder 50. As is obvious, the cone 54 placement in front of speaker has been made permanent by such construction, no longer being removable by removing the hollow cylinder as shown and detailed above. In any event, the same purpose is accomplished, namely deflecting the sound waves to the folds of the outer ear.

In all cases, it is anticipated that the area of the cone which resides over the ear canal will be of sufficient size as to totally cover the opening of the ear canal, and thus assuring that sound waves will not be aimed directly into the ear canal.

While preferred and alternate embodiments of Applicant's apparatus have been shown and described, it is appreciated that still other embodiments of the invention are possible and that there is no intent to limit the invention by such disclosure, but rather it is intended to cover all modifications and alternate embodiments falling within the spirit and the scope of the invention as defined by the appended claims.

I claim:

1. A device for deflecting sound from passage directly into a user's ear canal, said sound deflection device for attachment to a user's headset earphone speaker case comprising:

a hollow cylinder having a first and second end;

means to operably connect said first end of said hollow cylinder to the headset earphone speakers;

sound deflecting means located proximate said second end of said hollow cylinder; and structural members attached between said sound deflecting means and said hollow cylinder second end, said structural members defining openings interposed said hollow cylinder second end and said sound deflecting means to permit passage of sound waves from said hollow cylinder to the folds of skin on the outer ear and then to the user's ear canal.

2. The sound deflection device for attachment to a user's headset earphones as defined in claim 1 wherein said means to connect said hollow cylinder to said speaker case comprises clip means attached to said hollow cylinder adapted to engage and be secured to said speaker case.

3. The sound deflection device as defined in claim 2 wherein said sound deflecting means located proximate said hollow cylinder comprises a cone spatially located proximate the center of the second end of said hollow cylinder.

4. The sound deflection device as defined in claim 3 wherein said cone spatially located at the opening of said hollow cylinder second end is configured with the axis of the cone parallel to the circular axis of said hollow cylinder, and the apex of said cone pointing interiorly to said hollow cylinder.

5. The sound deflection device as defined in claim 4 wherein said structural members joining the sides of said hollow cylinder to said cone defines elongated bars.

6. The sound deflector as defined in claim 5 wherein the base of said cone is so situated as to be in the plane formed by the second annular end of said hollow cylinder.

7. The sound deflector as defined in claim 6 wherein said cone defines a cone having two parallel circular surfaces, and straight tapered sides.

8. The cone as defined in claim 6 defining a conical fustrum having two parallel circular surfaces with inwardly curved tapered sides.

9. A device for deflecting sound from passage directly into a user's ear canal, said sound deflection device comprising:

a headset frame to be worn about a user's head;

a hollow cylinder having two ends, a first of said ends operably attached to said headset frame;

a speaker situated interiorly to said first end of said hollow cylinder;

a cone spatially located proximate said second end of said cylinder; and structural elements attaching between said cone and said cylinder second end, said structural elements defining openings formed between said cylinder and said cone, said cone located centrally to said cylinder and so configured that its apex is pointing into said cylinder whereby sound emitting from the speaker is deflected off the sides of said cone into the folds of the ear before the sound enters the user's ear canal.

10. The sound deflection device as defined in claim 6 wherein the base of said cone is larger in diameter than is the diameter of the ear canal opening.

* * * * *